US006213710B1

(12) United States Patent
Remberg

(10) Patent No.: US 6,213,710 B1
(45) Date of Patent: Apr. 10, 2001

(54) METHOD AND APPARATUS FOR THRUST COMPENSATION ON A TURBOMACHINE

(75) Inventor: Axel Remberg, Mülheim an der Ruhr (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/170,183

(22) Filed: Oct. 13, 1998

Related U.S. Application Data

(63) Continuation of application No. PCT/DE97/00674, filed on Apr. 2, 1997.

(30) Foreign Application Priority Data

Apr. 11, 1996 (DE) ..... 196 14 335

(51) Int. Cl.[7] ..... F01D 25/26

(52) U.S. Cl. ..... 415/108; 415/1; 415/220; 415/214.1

(58) Field of Search ..... 415/108, 1, 214.1, 415/220, 104, 101, 102

(56) References Cited

U.S. PATENT DOCUMENTS 3,754,833 8/1973 Remberg ..... 415/108
3,844,675 * 10/1974 Remberg ..... 415/108

FOREIGN PATENT DOCUMENTS 281253 2/1912 (DE) .
1 152 703 8/1963 (DE) .
20 54 465 5/1972 (DE) .
2 218 500 10/1973 (DE) .
1 094 273 5/1955 (FR) .
59-213907 * 12/1984 (JP) ..... 415/176

* cited by examiner

*Primary Examiner*—Edward K. Look
*Assistant Examiner*—Richard Woo
(74) *Attorney, Agent, or Firm*—Herbert L. Lerner; Laurence A. Greenberg; Werner H. Stemer

(57) ABSTRACT

A method for thrust compensation on a corresponding turbomachine, in particular a turbo engine of pot-type construction. The turbomachine has an outer casing and an inner casing or blade carrier. At least one first area of an exterior of part of the inner casing is divided for axial thrust compensation into two partial areas for axial thrust compensation. Each of the two partial areas is subjected to a different pressure and the separation between the two pressures is brought about by at least one means, in particular a seal.

18 Claims, 2 Drawing Sheets

METHOD AND APPARATUS FOR THRUST COMPENSATION ON A TURBOMACHINE

CROSS-REFERENCE TO RELATED APPLICATION

This application is a continuation of copending International Application No. PCT/DE97/00674, filed on Apr. 2, 1997, which designated the United States.

BACKGROUND OF THE INVENTION

Field of the Invention

The present invention relates to a method and an apparatus on a turbomachine with an outer casing and an inner casing or blade carrier for thrust compensation. In particular, the area of application of the invention is in the field of turbo engines of pot-type construction, where a pressure of a fluid flowing through the turbomachine causes an axial force in the longitudinal direction of the shaft, at least on the inner casing.

It is known that, in the case of turbomachines with a high internal pressure, the casing is divided into an inner casing and an outer casing. A multi-channel casing of a steam turbine for high steam pressures and steam temperatures is described in Published, Non-Prosecuted German Patent Application DE 2 218 500 A, corresponding to U.S. Pat. No. 3,844,675. In the present configuration of the high-pressure turbine of pot-type construction, live steam enters the inner casing at a high pressure. After an expansion of about 20% of the total pressure drop of the part-turbine, the steam is passed through holes into the outer casing and thus compresses the inner casing in the region of the joints in the course of its further expansion. In subcritical steam conditions, the configuration with a blade carrier is chosen. Here, the full live-steam pressure is present in the space between the inner casing and the outer casing and thus presses the two halves of the carrier together. In the rest of the description, the term "inner casing" also includes the blade carrier in all cases. Given their superimposition, the pressures acting on various surfaces also ensure a resultant thrust on components, and this has to be absorbed by corresponding devices on the inner casing and/or outer casing and/or on the shaft. For this purpose, it is furthermore known for the interspace between the inner casing and the outer casing to be sealed off from the outlet side of the fluid flowing through the turbomachine, so that the pressure difference between the inlet and the outlet has to be accepted by the inner casing, while the outer casing has to withstand the outlet pressure on the outflow side and the pressure between the outer and inner casing relative to atmospheric pressure on the inflow side. The pressures present in the various spaces of a turbomachine ensure high axial forces, which must be transmitted via corresponding devices such as, for example, bayonet rings, threaded rings, Uhde-Brettschneider fasteners or screwed fastenings, to the outer casing or other suitable devices. In addition to possible large deformations, the forces also give rise to high surface pressures on corresponding supports.

The Published, Non-Prosecuted German Patent Application DE 2 218 500 A, for example, discloses a multi-shell casing of a steam turbine for high steam pressures and steam temperatures. An inner shell is clamped against the outer casing by a supporting ring and thus fixed axially. U.S. Pat. No. 3,754,833, in turn, and its priority document, German Patent DE 20 54 465 B2, describes a device for mounting and centering of shaft seal housings on the outer casing shells of turbomachines in a manner which allows thermal movement in a radial and concentric fashion. The turbine illustrated there has a pot-type casing with a joint normal to the axis. An inner casing carrying the fixed blades is inserted into the pot-type casing at a bearing and centering location. This centering location is formed by an Uhde-Brettschneider fastener. In the region of the shaft lead-throughs through the pot-type casing there are shaft seal housings on which sealing covers are mounted. Bypass passages in the inner casing serve for axial thrust compensation.

The constructional outlay in the case of turbomachines for absorbing the axial forces is, as explained above, very high overall. Since the efficiency of a turbomachine is greatly influenced by flow losses, the thrust forces must furthermore be absorbed in such a way that, given corresponding thermal expansions of the shaft and of the inner and outer casing, the radial gaps at the blade ends are as small as possible.

SUMMARY OF THE INVENTION

It is accordingly an object of the invention to provide a method and an apparatus for thrust compensation on a turbomachine which overcomes the above-mentioned disadvantages of the prior art methods and devices of this general type, which compensate for axial forces in the longitudinal direction of a shaft.

With the foregoing and other objects in view there is provided, in accordance with the invention, a method for providing an axial thrust compensation on a turbomachine, which includes: providing a turbomachine having an outer casing, a shaft, and an inner casing with an exterior region, a part of the exterior region of the inner casing defining at least one first area having two partial areas; separating the two partial areas with at least one separating means for providing a compensating axial thrust; and subjecting the turbomachine to a fluid flow having a pressure flowing through the turbomachine causing an axial force in a longitudinal direction of the shaft acting at least on the inner casing, subjecting each of the two partial areas of the at least one first area to different pressures for generating the compensating axial thrust, and a separation between the different pressures brought about by the at least one separating means.

The invention provides that in at least one first area of the exterior of a part of the inner casing is divided for axial thrust compensation into two partial areas for axial thrust compensation, each of which is subjected to a different pressure. The separation between the two pressures being brought about by at least one means, in particular a seal. The exterior of a part of the inner casing is preferably subjected to a pressure for axial thrust compensation that is at least as great as the outlet pressure of the fluid, and preferably approximately as great as the inlet pressure.

In an advantageous embodiment of the invention, the pressure for axial thrust compensation counteracts the axial force of the outlet pressure on the inner casing. The superimposition of the two pressures results in a reduced resultant pressure and this thus causes less thrust. The axial thrust compensation can be carried out, in particular, at the inner casing of the turbomachine. This ensures that the high constructional outlay required hitherto for fixing the inner casing can be reduced. The surface pressures occurring at the fixing elements are therefore lower and hence also lead to less severe deformation. In an advantageous development of the invention, the pressure on the outer part of the inner casing is set in accordance with the operating conditions, for example full load or part load. The axial thrust occurring at the inner casing can then be set by appropriate control of the pressure.

In addition to subjecting an outer part of the inner casing to a pressure for axial thrust compensation, the limitation of the dimensions of the outer part is furthermore carried out by the suitable means, preferably a seal. As a result, the axial thrust compensation at the inner casing can be influenced not only via the pressure but also via the effective area available to the pressure for the formation of an axial force. The effective area, as a first area, is divided by the means into the two partial areas. The effective area preferably includes at least one part of the outer end face of the inner casing. Depending on the construction of the machine, there is therefore the possibility of suitable dimensioning of the outer part of the inner casing for axial thrust compensation, in order to keep the thrust as small as possible. In accordance with the respective steam parameters of a part-turbine, the axial thrust can likewise be set by variation of the areas, defined by the diameter of one or two I-ring seals. The seal itself is thus subjected to pressure and, in particular, subjected to loading. By virtue of the seal, it is also possible for the respective pressure acting on the two partial areas to be applied between the inner casing and the outer casing.

In accordance with an added feature of the invention, there is the step of providing a blade carrier as the inner casing.

In accordance with an additional feature of the invention, there is the step of providing a turbo engine of pot-type construction as the turbomachine.

In accordance with another feature of the invention, there is the step of applying the different pressures acting on the two partial areas between the inner casing and the outer casing.

In accordance with a further added feature of the invention, there is the step of applying the two different pressures to an end face of the inner casing.

With the foregoing and other objects in view there is also provided, in accordance with the invention, a turbomachine, including: a turbomachine body having: a shaft; an inner casing partially enclosing the shaft and having an exterior region; an outer casing at least partially enclosing the inner casing; the turbomachine body conducting a fluid flow having an outlet pressure, the outlet pressure of the fluid flow flowing through the turbomachine body causing an axial force in a longitudinal direction of the shaft at least on the inner casing; a separating means; and a part of the exterior region of the inner casing defining a first area formed of two partial areas divided by the separating means, the two partial areas transmitting an axial pressure and generate a compensating axial thrust for countering the axial force.

In accordance with an added feature of the invention, the two partial areas transmitting the respective axial pressure are each subjected to a different pressure.

In accordance with an additional feature of the invention, the separating means is subjected to a pressure or is simultaneously subjected to two different pressures.

In accordance with another feature of the invention, the separating means is disposed between the inner casing and the outer casing or the separating means is disposed between and in direct contact with the inner casing and the outer casing.

In accordance with a further added feature of the invention, the separating means is a seal, in particular an I-ring seal, disposed around the shaft.

In accordance with a further additional feature of the invention, the inner casing has an end face, and the two partial areas at least partially include the end face.

In accordance with yet another feature of the invention, the two partial areas forming the compensating axial thrust are subjected to one of an inlet pressure and a pressure from an interior of the inner casing.

In accordance with a concomitant feature of the invention, the inner casing is a blade carrier and the turbomachine body is a turbo engine body of pot-type construction.

Other features which are considered as characteristic for the invention are set forth in the appended claims.

Although the invention is illustrated and described herein as embodied in a method and an apparatus for thrust compensation on a turbomachine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
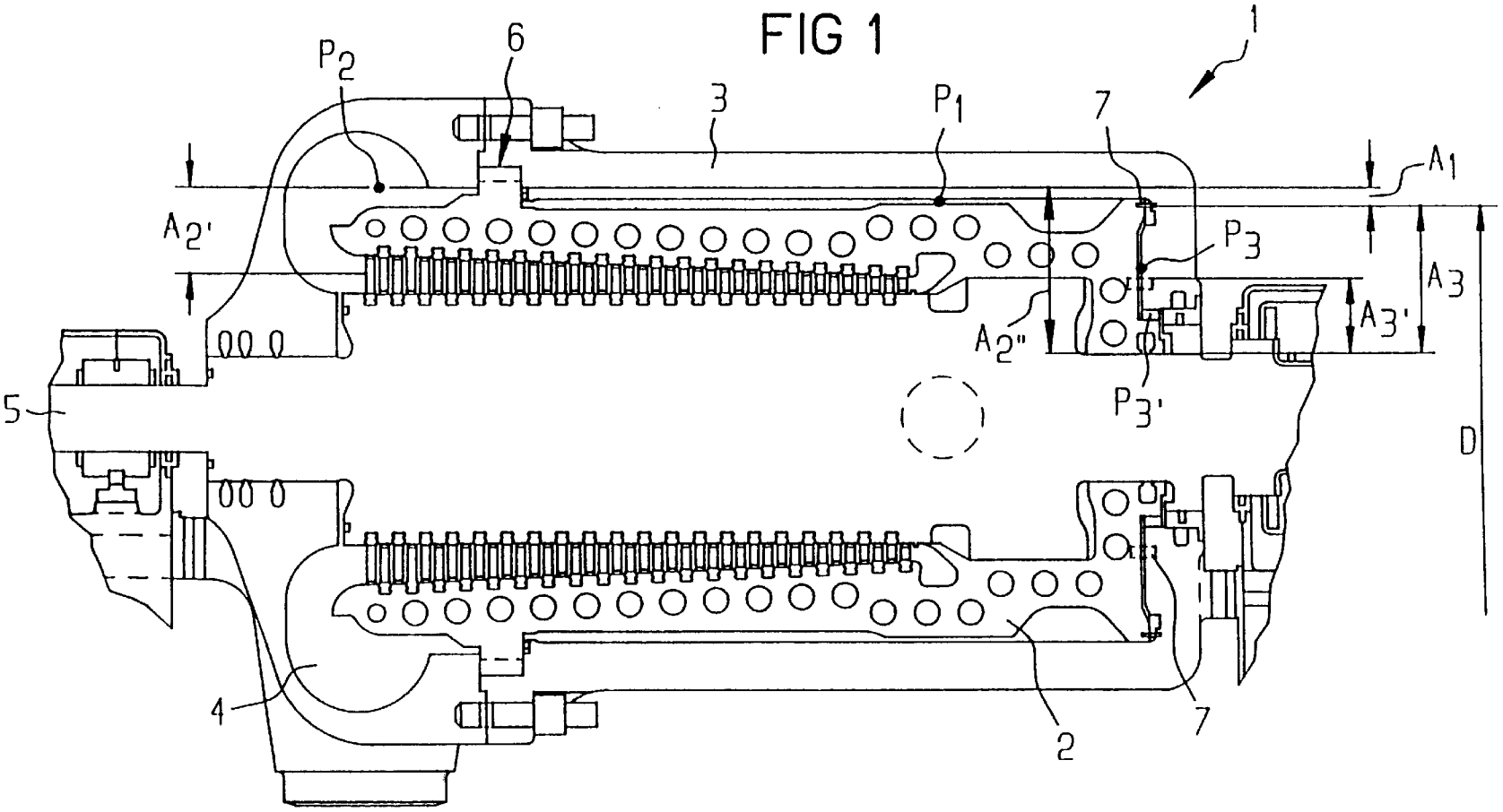
FIG. 1 is a diagrammatic view of an industrial high-pressure turbine of pot-shaped construction according to the invention.

Referring now to the figures of the drawing in detail and first, particularly, to FIG. 1 thereof, there is shown as an exemplary embodiment of a turbomachine 1 according to the invention, a high-pressure turbine 1 of pot-shape construction which has an inner casing 2 and an outer casing 3. A fluid 4 flowing through the turbomachine 1 enters with an inlet pressure P1 and leaves the high-pressure turbine 1 with an outlet pressure P2. The pressure difference between the inlet pressure and the outlet pressure leads to an axial thrust not only on the inner casing 2 but also on a shaft 5. Depending on the type of fixed blades and rotor blades, a differing pressure reduction in the fluid 4 flowing through takes place there, and the pressure reduction has an effect on the shaft 5 and the inner casing 2. On its outside, the inner casing 2 has an area A1 which is subjected to the inlet pressure P1. A pressure on the area A1 is preferably at least as great as the outlet pressure P2 of the fluid 4 from the turbomachine 1. In particular, it is also possible for the pressure on the area A1 to be as large as the inlet pressure of the fluid and/or a pressure in the interior of the inner casing 2. The area A1 preferably includes part of the end face of the inner casing 2. The axial thrust arising on the area A1 is superimposed on the axial force of the inner casing 2 which arises on the area A2, as a result of which axial thrust compensation takes place at the latter. By virtue of the axial thrust compensation, the fixing 6 of the inner casing 2 relative to the outer casing 3 is subjected to small surface pressures. This allows many different configuration variants for the introduction of an axial thrust force into the outer casing 3, e.g. the support rings used in the prior art can be omitted. The overall construction of such a turbomachine according to the invention can thus be simplified by virtue of the improved axial thrust compensation.

In the invention illustrated in FIG. 1, the area A1 of the outer part of the inner casing 2, which area transmits axial pressure, is bounded by a means 7 disposed around the shaft 5. The means 7, advantageously a seal, limits the pressure P1 acting on the area A1 which transmits the axial pressure, the use of the means 7 thus making possible precisely defined axial thrust compensation. The use of the means 7 of this kind furthermore offers the possibility of subjecting a further area A3 on the outer part of the inner casing 2 to a further pressure P3. The pressure P3 in conjunction with the area A3 then likewise makes a contribution to the axial thrust compensation. In the sense of the invention, areas A1 and A3 thus together form a first area of the outer part of the inner casing 2. Individually, areas A1 and A3 are then the partial areas.

The pressure P3, which is advantageously lower than the pressure P1, serves as a sealing pressure. Pressure and flow losses via the seal or seals forming means 7 can be reduced by means of this advantageous pressure gradation. As a result, the seal, in particular an I-ring seal, can not only be subjected to pressure but also be subjected to pressure loading. By using a plurality of the means 7, it is also possible, for the purpose of favorable pressure gradation, to create mutually separate areas for axial thrust compensation, as indicated by the means 7, drawn in broken lines, with the area A3' and the pressure P3'. By virtue of the structural geometry of the turbomachine 1, the seal 7 is advantageously fitted between the inner part of the outer casing 3 and the outer part of the inner casing 2, in particular in such a way that it has direct contact with the inner casing 2 and the outer casing 3. A suitable I-ring seal for seal 7 is one whose diameter D depends on the area A1 or A3 transmitting the desired axial force. An advantageous development of the 15 invention envisages that axial thrust compensation should take place not only at the inner casing 2 but also at the shaft 5. For this purpose, the turbomachine is configured in such a way that an area A2" which transmits axial pressure is subjected to the outlet pressure P2. It is thus possible for the axial thrust on the shaft 5 which occurs due to the pressure difference between the inlet pressure P1 and the outlet pressure P2 across the blades to be at least partially compensated.

Figure 2:
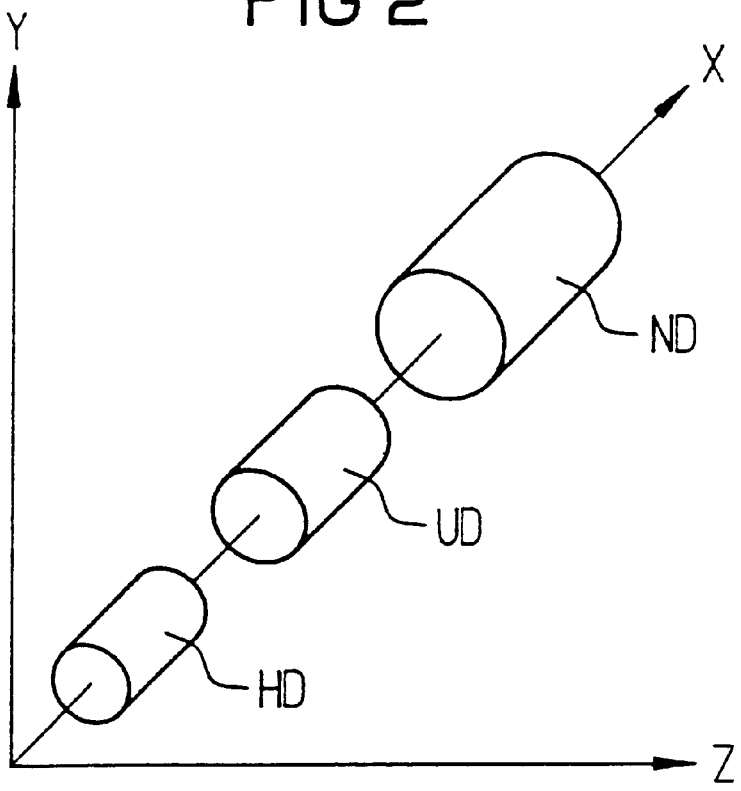
FIG. 2 is a perspective view of a configuration of a string of turbines.

FIG. 2 shows, in a schematic representation, the configuration of a high-pressure part HD, a medium-pressure part UD and a low-pressure part ND of a turbine on a shaft. This representation illustrates the fact that the forces stemming from the pressure P1 act on the area Al and those from the pressure P3 act on the area A3 in the negative X direction. Force stemming from the pressure P2 on the area A2", on the other hand, counteracts these forces in the positive X direction. The invention can thus be used for axial thrust compensation not only on a part-turbine but also on a string of turbomachines connected in series.

I claim:

1. A method for providing an axial thrust compensation on a turbomachine, which comprises:

providing a turbomachine having an outer casing, a shaft, and an inner casing with an exterior region, a part of the exterior region of the inner casing defining at least one first area having two partial areas;

separating the two partial areas with at least one separating means for providing a compensating axial thrust; and subjecting the turbomachine to a fluid flow having a pressure flowing through the turbomachine causing an axial force in a longitudinal direction of the shaft acting at least on the inner casing, subjecting each of the two partial areas of the at least one first area to different pressures for generating the compensating axial thrust, and a separation between the different pressures brought about by the at least one separating means.

2. The method according to claim 1, which comprises providing a blade carrier as the inner casing.

3. The method according to claim 1, which comprises using a seal as the at least one separating means.

4. The method according to claim 1, which comprises providing a turbo engine of pot-type construction as the turbomachine.

5. The method according to claim 1, which comprises using an I-ring seal as the at least one sealing means and subjecting the I-ring seal to pressure loading.

6. The method according to claim 1, which comprises applying the different pressures acting on the two partial areas between the inner casing and the outer casing.

7. The method according to claim 1, which comprises setting the different pressures acting on the two partial areas of the exterior region of the inner casing in accordance with a respective operating condition of the turbomachine.

8. The method according to claim 1, which comprises applying the two different pressures to an end face of the inner casing.

9. A turbomachine, comprising:

a turbomachine body including:

a shaft;

an inner casing partially enclosing said shaft and having an exterior region;

an outer casing at least partially enclosing said inner casing;

said turbomachine body conducting a fluid flow having an outlet pressure, the outlet pressure of the fluid flow flowing through said turbomachine body causing an axial force in a longitudinal direction of said shaft at least on said inner casing;

a separating means; and a part of said exterior region of said inner casing defining a first area formed of two partial areas divided by said separating means, said two partial areas transmitting an axial pressure and generate a compensating axial thrust.

10. The turbomachine according to claim 9, wherein said two partial areas transmitting the axial pressure are each subjected to a different pressure.

11. The turbomachine according to claim 10, wherein said separating means is subjected to a pressure.

12. The turbomachine according to claim 10, wherein said separating means is simultaneously subjected to two different pressures.

13. The turbomachine according to claim 9, wherein said separating means is disposed between said inner casing and said outer casing.

14. The turbomachine according to claim 9, wherein said separating means is disposed between and in direct contact with said inner casing and said outer casing.

15. The turbomachine according to claim 9, wherein said separating means is a seal disposed around said shaft.

16. The turbomachine according to claim 9, wherein said separating means is an I-ring seal disposed around said shaft.

17. The turbomachine according to claim 9, wherein said inner casing has an end face, and said two partial areas at least partially include said end face.

18. The turbomachine according to claim 9, wherein said inner casing is a blade carrier and said turbomachine body is a turbo engine body of pot-type construction.

* * * * *